US009325106B2

(12) United States Patent
Arcykiewicz

(10) Patent No.: US 9,325,106 B2
(45) Date of Patent: Apr. 26, 2016

(54) ANTI-DECOUPLING MEMBER FOR CONNECTOR COMPONENT

(71) Applicant: Amphenol Corporation, Wallingford, CT (US)

(72) Inventor: Robert R. Arcykiewicz, Bartlett, IL (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 14/206,487

(22) Filed: Mar. 12, 2014

(65) Prior Publication Data

US 2014/0273582 A1 Sep. 18, 2014

Related U.S. Application Data

(60) Provisional application No. 61/779,447, filed on Mar. 13, 2013.

(51) Int. Cl.

| | |
|---|---|
| ***H01R 13/62*** | (2006.01) |
| ***H01R 13/622*** | (2006.01) |
| ***H01R 13/639*** | (2006.01) |

(52) U.S. Cl.

CPC ..... *H01R 13/62* (2013.01); *H01R 13/622* (2013.01); *H01R 13/639* (2013.01)

(58) Field of Classification Search

CPC ..... H01R 13/622; H01R 13/639; H01R 13/28

USPC ..... 439/321, 312, 320

See application file for complete search history.

(56) References Cited

U.S. PATENT DOCUMENTS

| | | | | | |
|---|---|---|---|---|---|
| 3,618,721 | A * | 11/1971 | Hare | F16D 41/206 | 192/35 |
| 4,066,315 | A * | 1/1978 | Arneson | H01R 13/622 | 439/311 |
| 4,165,910 | A * | 8/1979 | Anderson | H01R 13/625 | 439/318 |
| 4,359,255 | A * | 11/1982 | Gallusser | H01R 13/623 | 439/316 |
| 4,437,552 | A * | 3/1984 | Toyama | F16D 13/025 | 192/12 BA |
| 4,508,408 | A * | 4/1985 | Shepler | H01R 13/622 | 439/313 |
| 4,536,048 | A * | 8/1985 | Schildkraut et al. | | 439/312 |

(Continued)

FOREIGN PATENT DOCUMENTS

| | | |
|---|---|---|
| DE | 20 2008 013 794 | 4/2009 |
| EP | 2 395 609 | 12/2011 |
| WO | WO/2013/015544 | 1/2013 |

*Primary Examiner* — Abdullah Riyami
*Assistant Examiner* — Thang Nguyen
(74) *Attorney, Agent, or Firm* — Blank Rome LLP; Charles R. Wolfe, Jr.; Tara L. Marcus

(57) ABSTRACT

A coupling member for a connector component that includes an inner sleeve configured to surround a shell and that sleeve is rotatable with respect to the shell in a tightening direction to mate with the mating component and a release direction opposite the tightening direction. The inner sleeve has an interface portion and an engagement member. A spring member is wrapped around the shell adjacent the inner sleeve. The spring member has a first tab end that engages the engagement member. When the inner sleeve is rotated with respect to the shell in the tightening direction, the inner sleeve pushes the first tab of the spring member, thereby loosening the spring member around the shell allowing the inner sleeve to rotate in the tightening direction to engage the mating connector component. The first tab end of the spring member prevents the inner sleeve from rotating in the release direction.

16 Claims, 4 Drawing Sheets

(56) References Cited

U.S. PATENT DOCUMENTS

| | | | | | |
|---|---|---|---|---|---|
| 4,588,246 | A * | 5/1986 | Schildkraut et al. | 439/312 | |
| 4,639,064 | A * | 1/1987 | Knapp | H01R 13/622 | 439/318 |
| 4,648,670 | A * | 3/1987 | Punako et al. | 439/321 | |
| 4,726,782 | A * | 2/1988 | Hager et al. | 439/321 | |
| 4,793,821 | A * | 12/1988 | Fowler et al. | 439/321 | |
| 6,152,753 | A * | 11/2000 | Johnson | H01R 13/622 | 439/312 |
| 7,413,457 | B2 * | 8/2008 | Mehnert | H01R 13/622 | 285/81 |
| 7,544,085 | B2 | 6/2009 | Baldwin | | |
| 7,625,226 | B1 | 12/2009 | Gastineau | | |
| 7,905,741 | B1 | 3/2011 | Wade et al. | | |
| 7,914,311 | B1 | 3/2011 | Gallusser et al. | | |
| 8,215,977 | B2 * | 7/2012 | Zapf | H01R 13/625 | 439/352 |
| 2011/0143575 | A1 * | 6/2011 | Meynier | H01R 13/622 | 439/370 |

* cited by examiner

ANTI-DECOUPLING MEMBER FOR CONNECTOR COMPONENT

RELATED APPLICATION

The present application claims priority to U.S. provisional application No. 61/779,447, filed on Mar. 13, 2013.

FIELD OF THE INVENTION

The present invention relates to an anti-decoupling member for a connector component. In particular, the present invention relates to a coupling member having rotatable inner and outer sleeves, and a spring member for maintaining engagement between connector components even when subject to vibration.

BACKGROUND OF THE INVENTION

A traditional connector system consists of a plug component and a receptacle component. The receptacle usually contains a threaded outer front portion and the plug usually has a ring that engages the threads of the receptacle. To mechanically mate the plug and receptacle components, the plug is inserted into the receptacle and the ring is threaded onto the receptacle and torque to an appropriate value per the thread size.

When the mated connector components are mounted to an electrical equipment chassis and the equipment produces vibration, these vibrations are often times transferred to the mated connector components. Under vibration, the threaded ring of the plug may loosen or back-off of the receptacle. As the ring backs off, the plug disconnects from the receptacle. Attempts to address the problem of the plug component backing off of the receptacle component when subjected to vibration have been complex and require additional tools.

Therefore, a need exists for a connector system that prevents decoupling of its components even under vibration, is simple in design, and does not require tools.

SUMMARY OF THE INVENTION

Accordingly, the present invention provides a coupling member for a connector component that comprises an inner sleeve configured to surround a shell near or at an interface end of the shell. The inner sleeve is rotatable with respect to the shell in a tightening direction to mate with the mating connector component and a release direction opposite the tightening direction. The inner sleeve has an interface portion on an inner surface thereof adapted to mate with the mating connector component and has an engagement member. A spring member is wrapped around the shell adjacent the inner sleeve. The spring member has at least a first tab end that engages the engagement member of the inner sleeve. When the inner sleeve is rotated with respect to the shell in the tightening direction, the inner sleeve pushes the first tab of the spring member, thereby loosening the spring member around the shell allowing the inner sleeve to rotate in the tightening direction to engage the mating connector component. The first tab end of the spring member prevents the inner sleeve from rotating in the release direction.

The present invention may also provide a connect component that comprises a shell that has an interface end for engaging a mating connector component. A coupling member is supported on the shell near or at the interface end of the shell that is adapted to mate with a mating connector component. The coupling member is rotatable with respect to the shell in a tightening direction to mate the connector component with the mating connector component and in a release direction opposite the tightening direction. The coupling member includes an inner sleeve that surrounds and is rotatable coupled to the shell. The inner sleeve has an interface portion and an engagement member. A spring member is wrapped around the shell adjacent the inner sleeve. The spring member has a first tab end and a second tab end. An outer sleeve surrounds the inner sleeve and the spring member. When the coupling member is rotated with respect to the shell in the tightening direction, the engagement member of the inner sleeve engages the first tab of the spring member, thereby loosening the spring member around the shell allowing the inner sleeve to rotate in the tightening direction to engage the interface portion with the mating connector component and the first tab end preventing the inner sleeve from rotating in the release direction. When the outer sleeve is rotated with respect to the shell in the release direction, the outer sleeve engages the second tab end of the spring member to loosen the spring member, thereby allowing the inner sleeve to rotate in the release direction to disengage the interface portion from the mating connector component.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection the accompanying drawings, wherein.

DETAILED DESCRIPTION OF THE EXEMPLARY EMBODIMENTS

Figure 1:
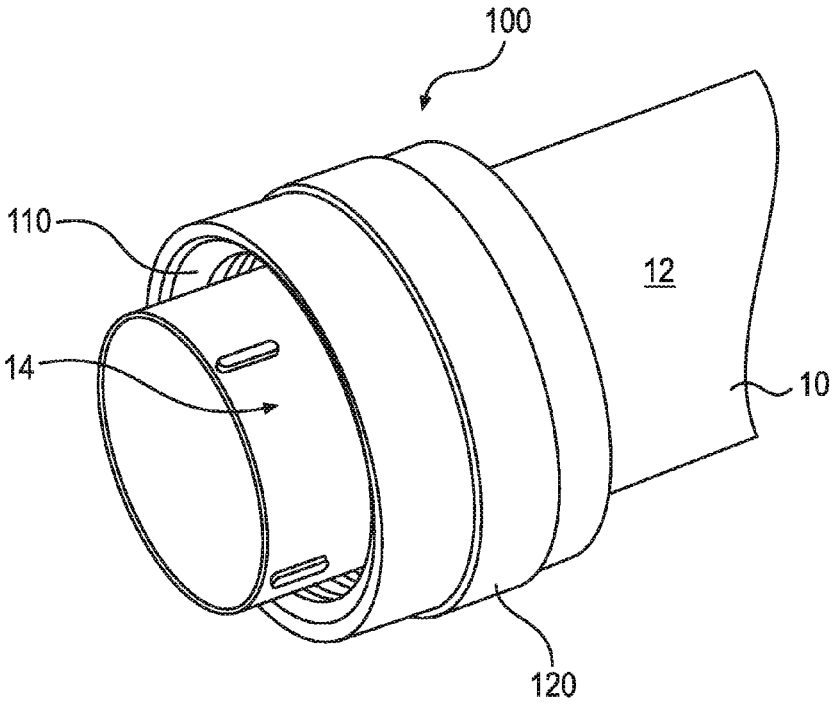
FIG. 1 is a perspective view of an anti-decoupling member according to an exemplary embodiment of the present invention.

Referring to the FIGS. 1, 2, 3A, 3B, 4, 5A and 5B, the present invention relates to a coupling member 100 for a connector component, such as a conductive shell, 10 that includes an anti-decoupling feature for preventing loosening of the coupling member 100 even when subjected to vibration. The coupling member 100 further provides a manual releasing feature that allows decoupling of the coupling member 100 when desired.

The coupling member 100 is disposed on a connector component, such as a plug or receptacle. In particular, the coupling member 100 surrounds an outer surface 12 of the conductive shell 10 of the connector component at or near the interface end 14 thereof. The interface end 14 of the connector component is adapted to mate with a mating connector component (not shown). The coupling member 100 rotates with respect to the shell 10 in a tightening direction (e.g. counterclockwise when viewing the connector component from its interface end 14) when mating the connector component with its mating component. The coupling member 100 is rotatable with respect to the shell 10 in a release direction opposite the tightening direction when the manual releasing feature is engaged to unmate the connector components.

Figure 2:
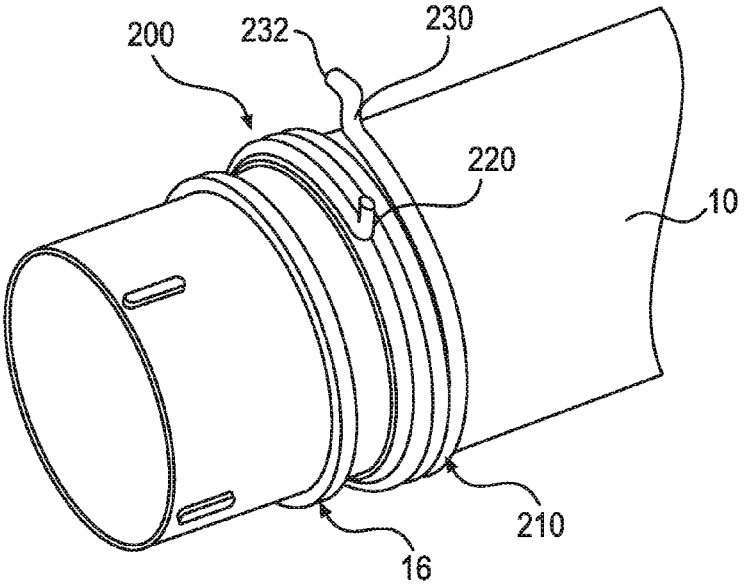
FIG. 2 is a perspective view of a spring, member of the anti-decoupling member illustrated in FIG. 1.

The coupling member 100 according to an exemplary embodiment of the present invention generally includes an inner sleeve 110, an outer sleeve 120, and a spring member 200. As seen in FIGS. 1 and 2, the inner sleeve 110 surrounds the shell 10, the spring member 200 is wrapped around the shell 10, and the outer sleeve 120 covers both the inner sleeve 110 and the spring member 200. The spring member 200 includes a spring body 210 that preferably has an inner diameter that is slightly smaller than the outer diameter of the shell 10 such that the spring member 200 fits tightly around the shell 10. The spring member 200 may include first and second tab ends 220 and 230 that are at opposite ends of the spring body 210, as best seen in FIG. 2. The first tab end 220 preferably extends outwardly away from the outer surface 12 of the shell 10 such that the first tab end 220 is generally perpendicular to the spring body 210. The second tab end 230 may be raised from the shell 10 at angle, preferably about a 45° angle, respect to the spring body 210. An end surface 232 of the second tab 230 forms an abutment. The spring member 200 is preferably a torsion spring.

Figure 3A:
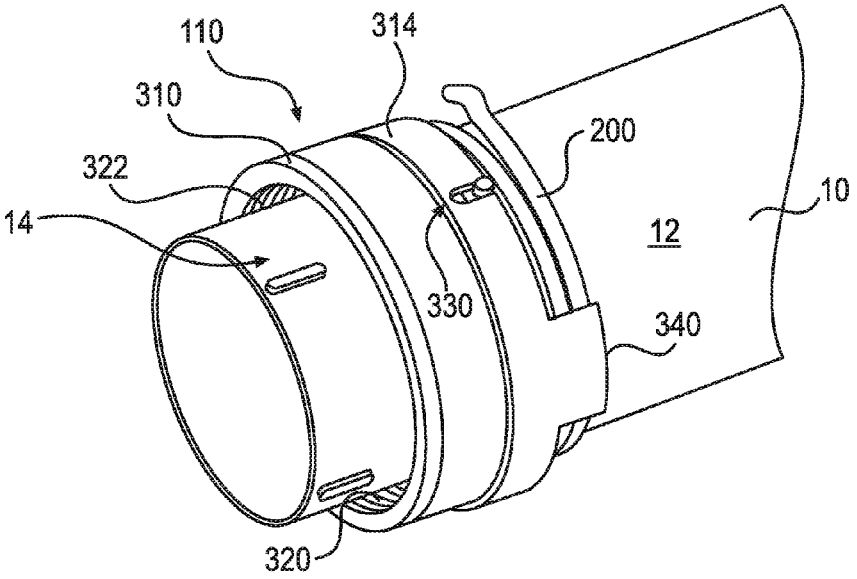
FIGS. 3A and 3B are perspective views of an inner sleeve of the anti-decoupling member illustrated in FIG. 1.
Figure 3B:
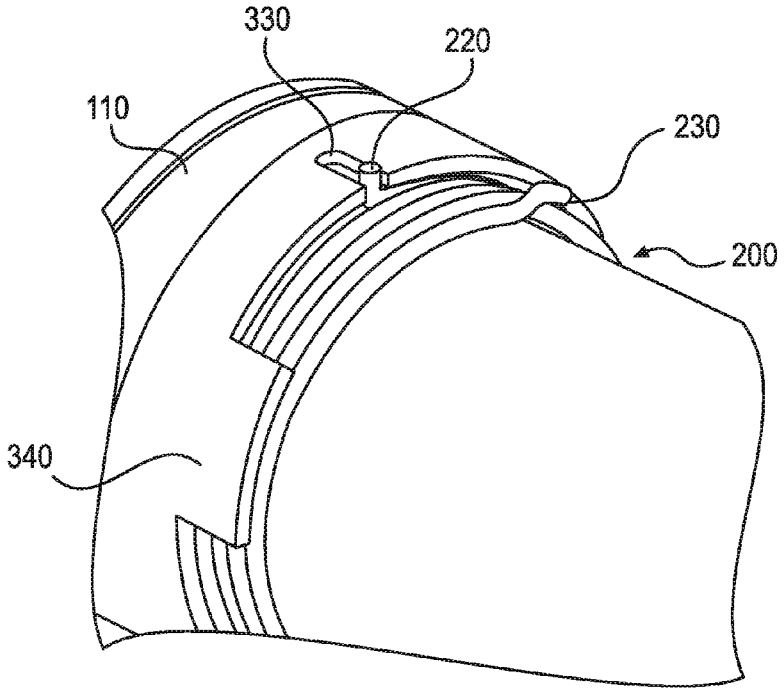
Figure 4:
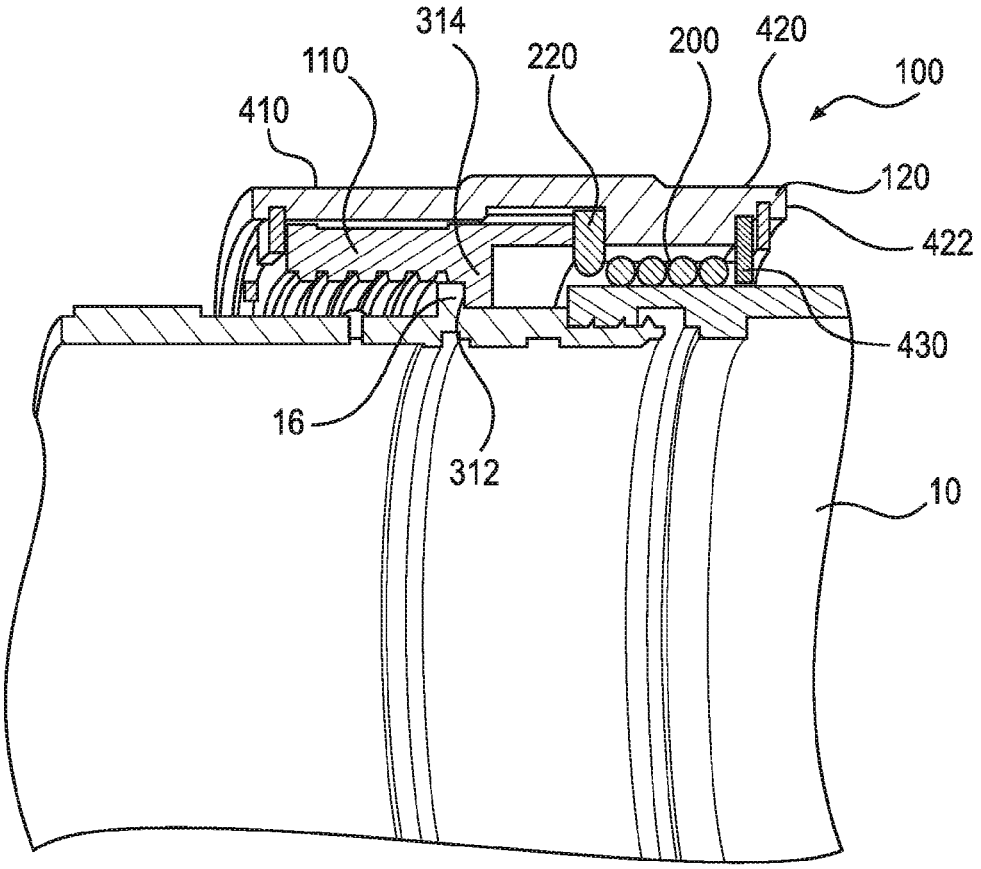
FIG. 4 is a cross-sectional view of the anti-decoupling member illustrated in FIG. 1.
Figure 5A:
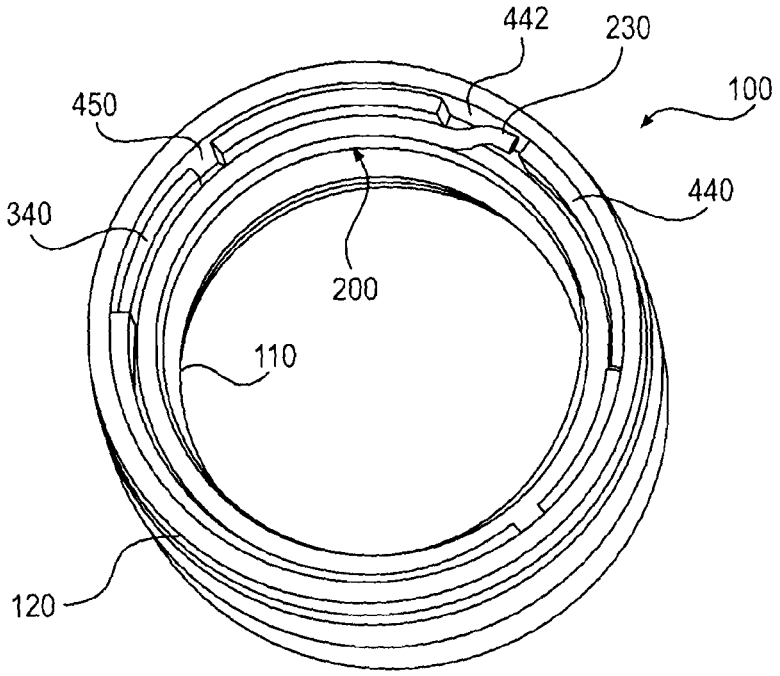
FIG. 5A is an end view of the anti-decoupling member illustrated in FIG. 1.

As seen in FIGS. 3A, 3B and 4, the inner sleeve 110 is located adjacent to the spring member 200 on the shell 10. The inner sleeve 110 generally includes an interface portion 310, a retaining shoulder 312, and an extension portion 314. The interface portion 310 is near or at the interface end 14 of the shell 10 and has threads 320 for engaging the mating connector component. The space 322 between the threads 320 and the outer surface 12 of the shell 10 is sized to receive an interface end of the mating connector component. The retaining shoulder 312 abuts a portion, such as a rib 16, of the shell 10, thereby restricting the axial movement of the inner sleeve 110. The extension portion 314 of the inner sleeve 100 includes an engagement member 330 for engaging the first tab end 220 of the spring member 200. The engagement member 330 is preferably a notch at the perimeter of the extension portion 314 that is sized to receive the first tab end 220. Also extending from the perimeter of the extension portion 314 of the inner sleeve 110 is at least one key 340. More than one key 340 may be provided, and preferably two keys are provided that may be about 180° apart, for example, as seen in FIG. 5A. The one or more keys 340 extend over the spring body 210 of the spring member 200 and engage the outer sleeve 120.

Figure 5B:
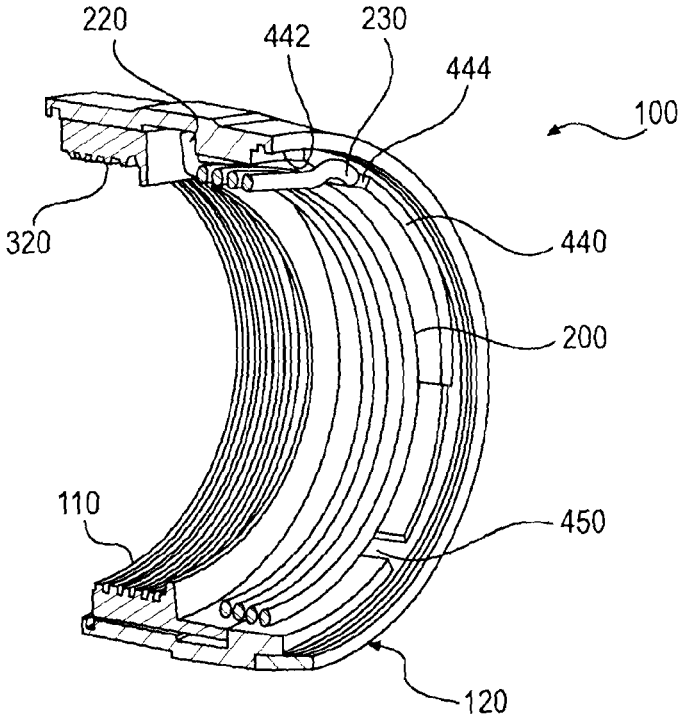
FIG. 5B is a partial perspective view of the anti-decoupling member illustrated in FIG. 5A.

As seen in FIGS. 4, 5A and 5B, the outer sleeve 120 covers both the inner sleeve 110 and the spring member 200. The inner surface of the outer sleeve 120 has first and second portions 410 and 420. The first portion 410 is adapted to accommodate the inner sleeve 110 and the second portion 420 is adapted to accommodate the spring member 200, as best seen in FIG. 4. A retaining ring 430 couples the outer sleeve 120 to the shell 10 and restricts the outer sleeve's axial movement with respect to the shell 10 while allowing the outer sleeve 120 to rotate with respect to the shell 10. At or near an end 422 of the second portion 420 of the outer sleeve 120, an inner shoulder 440 extends from the inner surface of the outer sleeve 120, as seen in FIGS. 5A and 5B. The inner shoulder 440 defines a recessed area 442 sized to accommodate the second tab end 230 of the spring member 200 and defines an abutment wall 444 that abuts the end surface 232 of the second tab end 230. Also at or near the end 422 of the outer sleeve 120 is one more key slots 450 that receive the corresponding one or more keys 340 of the inner sleeve 110, thereby coupling the inner and outer sleeves 110 and 120 together such that inner sleeve 110 rotates with the outer sleeve 120 when the outer sleeve is rotated with respect to the shell 10.

The coupling member 100 ensures that the connector component and its mating connector component remain mated until manually released. To couple the connector components, the interface end 14 of the shell 10 engages the corresponding interface end of the mating connector component. The outer sleeve 120 is then rotated, along with the inner sleeve 110, with respect to the shell 10 in the tightening direction so that the threads 320 of the inner sleeve 110 engage corresponding threads of the mating connector component until tight. In doing so, the engagement member 330 of the inner sleeve 110 engages the first tab end 220 of the spring member 200 and pushes against the same as the inner sleeve 110 rotates in the tightening direction. By pushing against the spring member's first tab end 220, the spring member 200 is loosened or unwinds around the shell 10, thus allowing the spring member 200 to move and rotate with respect to the shell 10. That, in turn, allows the inner sleeve 110 to rotate in the tightening direction to engage the mating connector component.

To maintain the engagement described above between the connector components, even under conditions such as vibration, the spring member 200 prevents the inner sleeve 110 from rotating in the opposite or release direction. In particular, the first tab end 220 of the spring member 200 acts as a stop if the inner sleeve 110 is moved or rotated in the release direction. That is, the engagement member 330 catches on the first tab 220 end which tightens the spring member 200 around the shell 10, thereby preventing the spring member 200 from moving or rotating in the release direction with respect to the shell 10. Because the first tab end 220 is received in the engagement member 330, that tightening of the spring member 200 around the shell 10 prevents the inner sleeve 110 from rotating in the release direction with respect to the shell.

The connector components then can only be released manually by rotating the outer sleeve 120 in the release direction. In particular, when the outer sleeve 120 is rotated in the release direction, the abutment wall 444 of the outer sleeve's inner shoulder 440 abuts and pushes against the end surface 232 of the second tab end 230 of the spring member 200. By pushing against the second tab end 230, the spring member 200 is loosened, thereby allowing the spring member 200 to unwind and rotate with respect to the shell 10. That, in turn, allows the inner sleeve 110 to rotate in the release direction when the outer sleeve is rotated in the release direction, via the keys 340 being received in the slots 450, to disengage the threads 320 of the inner sleeve 110 from the mating connector component.

While a particular embodiment has been chosen to illustrate the invention, it will be understood by those skilled in the art that various changes and modifications can be made therein without departing from the scope of the invention as defined in the appended claims. For example, the inner sleeve 100 may include any known engagement at the interface portion 310, including threads 320, for engaging the mating connector component.

What is claimed is:

1. A coupling member for a connector component, comprising:

an inner sleeve configured to surround a shell near or at an interface end of the shell, said inner sleeve being rotatable with respect to the shell in a tightening direction to mate with the mating connector component and a release direction opposite the tightening direction, said inner sleeve having an interface portion on an inner surface thereof adapted to mate with the mating connector component, and said inner sleeve having an engagement member;

a spring member wrapped around the shell adjacent said inner sleeve, said spring member having at least a first tab end that engages said engagement member of said inner sleeve; and an outer sleeve surrounding said inner sleeve and said spring member, said outer sleeve engaging a second tab end of said spring member, wherein when said inner sleeve is rotated with respect to the shell in the tightening direction, said inner sleeve pushes said first tab of said spring member, thereby loosening said spring member around the shell allowing said inner sleeve to rotate in said tightening direction to engage the mating connector component and said first tab end of said spring member preventing said inner sleeve from rotating in said release direction.

2. The coupling member for a connector component according to claim 1, wherein said engagement member of said inner sleeve is a notch and said first tab end of said spring member is received in said notch.

3. The coupling member for a connector component according to claim 2, wherein said spring member is a torsion spring.

4. The coupling member for a connector component according to claim 1, wherein said second tab end of said spring member abuts an inner shoulder of said outer sleeve.

5. The coupling member for a connector component according to claim 1, wherein said inner and outer sleeves are coupled to one another.

6. The coupling member for a connector component according to claim 5, wherein said inner sleeve has a key extending over said spring member that engages a key slot of said outer sleeve.

7. The coupling member for a connector component according to claim 1, wherein said interface portion of said inner sleeve includes threads.

8. A connector component, comprising:

a shell having an interface end for engaging a mating connector component; and a coupling member supported on said shell near or at said interface end of said shell that is adapted to mate with a mating connector component, said coupling member being rotatable with respect to said shell in a tightening direction to mate the connector component with the mating connector component and in a release direction opposite said tightening direction, said coupling member including, an inner sleeve surrounding and rotatably coupled to said shell, said inner sleeve having an interface portion and an engagement member, a spring member wrapped around said shell adjacent said inner sleeve, said spring member having a first tab end and a second tab end, and an outer sleeve surrounding said inner sleeve and said spring member, wherein when said coupling member is rotated with respect to said shell in the tightening direction, said engagement member of said inner sleeve engages said first tab of said spring member, thereby loosening said spring member around said shell allowing said inner sleeve to rotate in the tightening direction to engage said interface portion with the mating connector component and said first tab end preventing said inner sleeve from rotating in said release direction, and wherein when said outer sleeve is rotated with respect to said shell in said release direction, said outer sleeve engages said second tab end of said spring member to loosen said spring member, thereby allowing said inner sleeve to rotate in said release direction to disengage said interface portion from the mating connector component.

9. The connector component according to claim 8, wherein said engagement member of said inner sleeve is a notch and said first tab end of said spring member is received in said notch in said inner sleeve.

10. The connector component according to claim 9, wherein said spring member is a torsion spring.

11. The connector component according to claim 8, wherein said inner and outer sleeves are coupled to one another.

12. The connector component according to claim 11, wherein said inner sleeve has a key extending over said spring member that engages a key slot of said outer sleeve.

13. The connector component according to claim 8, wherein said second tab end of said spring member abuts an inner shoulder of said outer sleeve.

14. The connector component according to claim 8, wherein said interface portion of said inner sleeve includes threads.

15. The connector component according to claim 8, wherein said inner sleeve has a plurality of keys extending over said spring member, each of said plurality of keys engages a key slot of said outer sleeve.

16. The connector component according to claim 15, wherein said inner sleeve includes inner threads.

* * * * *